US005657658A

United States Patent [19]

Witte

[11] Patent Number: 5,657,658

[45] Date of Patent: Aug. 19, 1997

[54] APPARATUS FOR SHAPING AND TRANSPORTING WIRE BINDING ELEMENTS FOR PERFORATED SHEETS

[75] Inventor: Fritz Witte, Wendlingen, Germany

[73] Assignee: Womako Maschinenkonstruktionen GmbH, Nürtingen, Germany

[21] Appl. No.: 571,142

[22] Filed: Dec. 12, 1995

[30] Foreign Application Priority Data

Feb. 17, 1995 [DE] Germany ..... 195 05 361.3

[51] Int. Cl.[6] ..... B21F 45/16

[52] U.S. Cl. ..... 72/187; 140/71 R

[58] Field of Search ..... 72/187; 140/71 R, 140/89, 90, 91

[56] References Cited

U.S. PATENT DOCUMENTS

| | | | |
|---|---|---|---|
| 1,034,060 | 7/1912 | Beeman | 140/91 |
| 1,246,145 | 11/1917 | Nelson | 140/91 |
| 2,378,058 | 6/1945 | Blumensaadt | 140/91 |
| 4,507,948 | 4/1985 | Wallis | 72/187 |
| 4,873,858 | 10/1989 | Jones . | |

FOREIGN PATENT DOCUMENTS

| | | |
|---|---|---|
| 0292265 | 11/1988 | European Pat. Off. . |
| 919345 | 10/1937 | Germany . |
| 3404114 | 8/1984 | Germany . |
| 1133153 | 11/1968 | United Kingdom . |

*Primary Examiner*—Lowell A. Larson
*Attorney, Agent, or Firm*—Darby & Darby

[57] ABSTRACT

An apparatus which is used to impart a specific configuration to substantially flat elongated strips of deformable wire binding elements for stacks of overlapping perforated sheets or the like has a transporting unit serving to advance binding elements lengthwise in a predetermined direction along an elongated path, a unit which converts strips in a first portion of the path into transversely curved intermediate products having a substantially C-shaped cross-sectional outline and a shape which at least approximates the predetermined configuration, and an altering unit which serves to deform—in a second portion of the path downstream of the first portion—at least those intermediate products the shape of which departs from the predetermined configuration. The altering unit can comprise a unit which serves to stretch at least some of the intermediate products in the predetermined direction and/or a unit which serves to bend at least some of the intermediate products at least substantially transversely of the predetermined direction.

19 Claims, 5 Drawing Sheets

Fig.2
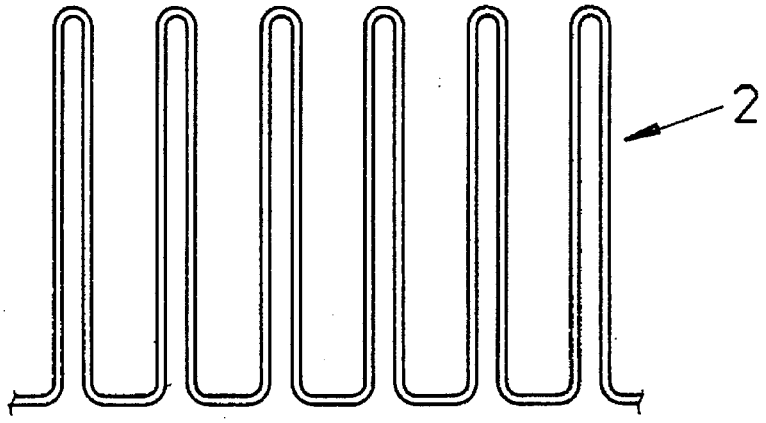
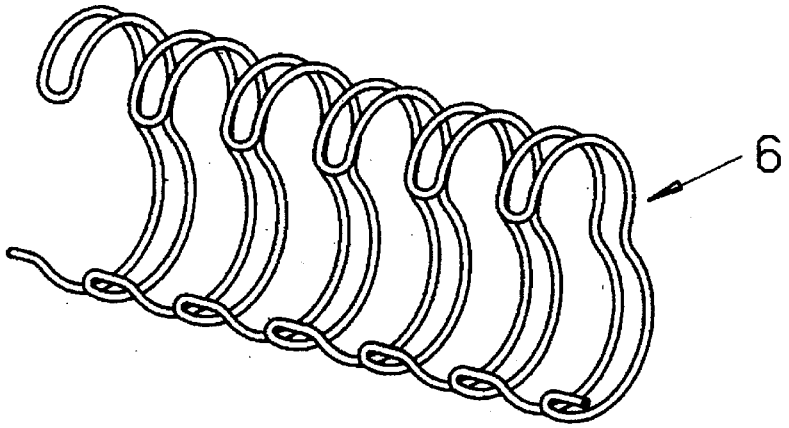
Fig.3

APPARATUS FOR SHAPING AND TRANSPORTING WIRE BINDING ELEMENTS FOR PERFORATED SHEETS

BACKGROUND OF THE INVENTION

The invention relates to improvements in apparatus for making binding elements for perforated sheets, and more particularly to improvements in apparatus for shaping and transporting such binding elements. Still more particularly, the invention relates to improvements in apparatus for imparting a predetermined shape to substantially flat strips of deformable wire binding elements for perforated sheets forming part of books, brochures, pamphlets, magazines, journals, pads, catalogues, calendars and/or other stationery or analogous products.

U.S. Pat. No. 4,873,858 granted Oct. 17, 1989 to Jones for "Manufacture of wire binding elements" discloses a machine which is designed to transform a zig-zag wire into a slotted tube that is ready for use as a binding element for accumulations of perforated sheets of paper or the like. The patented machine is provided with means for converting a flat strip of zig-zag wire into a comb like strip having a substantially C-shaped cross-sectional outline and being ready to be assembled with stacks of perforated sheets made of paper or other suitable imprinted and/or unprinted material. Once a comb-like strip is introduced into the perforations of a pile of aligned perforated sheets, the strip is closed to form a tube which confines the sheets of the pile to pivotal movements about the longitudinal axis of the tube.

A drawback of heretofore known machines and apparatus for the making of the above outlined binding elements is that the final shape of such products often departs from an optimum shape. This is attributable to tensions which develop in the binding elements as a result of deformation of substantially flat zig-zag wire strips into comb-like strips. Any departure of the configuration of comb-like strips from an optimum configuration can entail the development of problems in connection with the introduction of such imperfect strips into the perforations of piles of overlapping sheets and/or in connection with the predictability and convenience of pivoting of sheets in the thus obtained book, magazine, pad or an analogous product relative to each other.

OBJECTS OF THE INVENTION

An object of the invention is to provide an apparatus which can turn out high-quality binding elements for accumulations of overlapping perforated sheets of paper or the like.

Another object of the invention is to provide an apparatus which can turn out long or short series of binding elements having identical shapes which match or at least very closely approximate an optimum shape.

A further object of the invention is to provide the above outlined apparatus with novel and improved means for transporting blanks of partly finished and finished binding elements.

An additional object of the invention is to provide the above outlined apparatus with novel and improved means for repeatedly influencing the configuration of blanks of binding elements for accumulations of overlapping perforated paper sheets and/or the like.

Still another object of the invention is to provide an apparatus which is designed to prevent internal stresses which develop during conversion of substantially flat strips or blanks into binding elements from adversely influencing the ultimate shape of such binding elements.

A further object of the invention is to provide an apparatus wherein the blanks of, partially finished and finished binding elements can be advanced continuously and at an elevated speed without adversely influencing the quality of the ultimate products.

Another object of the invention is to provide a novel and improved method of making high-quality binding elements for accumulations of aligned overlapping perforated sheets of paper or the like.

An additional object of the invention is to provide a method of preventing internal tensions of converted blanks from influencing the configuration of binding elements for accumulations of aligned overlapping perforated sheets of paper or the like.

SUMMARY OF THE INVENTION

The invention is embodied in an apparatus for imparting a predetermined shape to substantially flat strips of deformable so-called wire binding elements for perforated sheets forming part of books, brochures, pamphlets, pads and/or other stationery or analogous products. The improved apparatus comprises means for transporting wire binding elements in a predetermined direction along a predetermined path, means for converting strips of wire binding elements in a first portion of the predetermined path into transversely curved intermediate products (these can have or normally have a substantially C-shaped cross-sectional outline) exhibiting a shape at least approximating the predetermined shape, and means for altering in a second portion of the predetermined path (downstream of the first portion as seen in the predetermined direction) at least those intermediate products the shape of which departs from the predetermined shape so that the shape of the thus altered products matches or at least more closely approximates the predetermined shape.

The altering means, or at least a portion of the altering means, can form part (and preferably forms part) of the transporting means.

In accordance with a presently preferred embodiment, the altering means at least comprises means for stretching the intermediate products in the predetermined direction. Such stretching means can comprise first and second rotary members which are spaced apart from each other in the predetermined direction and have portions (e.g., in the form of or at least resembling gear teeth) mating with complementary portions of the intermediate products in the second portion of the predetermined path. In accordance with a presently preferred embodiment, the rotary members include gears or parts resembling gears and having at least substantially identical circular pitches. The rotary members are rotatable about discrete axes (which are or can be parallel to each other), and at least one of these rotary members: is preferably angularly adjustable about one of the axes (e.g., about its own axis) relative to the other rotary member. The at least one rotary member is (or can be) located downstream of the other rotary member, as seen in the predetermined direction. The at least one rotary member can be angularly adjustable relative to the other rotary member at least in a sense to increase or enhance the stretching action of the rotary members upon the intermediate products in the second portion of the predetermined path.

The stretching means can further comprise means for transmitting torque between the first and second rotary members, and such torque transmitting means can comprise a rotary intermediate member (e.g., a pulley or a sprocket wheel) which is rotatable about a third axis and is adjustable jointly with the first rotary member about the axis of the second rotary member. The first rotary member is preferably adjustable about the third axis relative to the intermediate member. The torque transmitting means can further comprise at least one first endless flexible torque transmitting element (e.g., an endless belt or an endless chain) which is trained over the first rotary member and the intermediate member, and at least one second endless torque transmitting element which is trained over the second rotary member and the intermediate member. The second endless flexible element can transmit torque from the second rotary member to the intermediate member, and the first endless flexible element can transmit torque from the intermediate member to the first rotary member.

The first and second rotary members can engage intermediate products at opposite sides of the second portion of the predetermined path. In such apparatus, the first rotary member is preferably adjustable relative to the second portion of the predetermined path about an axis which is remote from the axes of the first and second rotary members.

In addition to or in lieu of the stretching means, the altering means can include means for bending the intermediate products in the second portion of the predetermined path. The bending means can comprise at least one bending device (e.g., in the form of a pin, a roller or the like) which serves to bend the intermediate products substantially transversely of the predetermined direction. Such at least one bending device is or can be adjustable relative to the second portion of the predetermined path in a plurality of different directions, e.g., in at least one first direction and in at least one second direction extending at least substantially at right angles to the at least one first direction. This enhances the versatility of the altering means, the same as the adjustability of the aforementioned rotary member or members of the stretching means.

If the altering means includes stretching and bending means, the stretching means preferably includes first and second portions (such as the aforediscussed first and second rotary members) which are respectively disposed downstream and upstream of the bending means as seen in the predetermined direction. The bending means can include the aforementioned at least one bending device which is arranged to engage the intermediate products in the second portion of the predetermined path between the first and second portions of the stretching means, and a support for the at least one bending device. The latter is or can be adjustably mounted on the support. For example, the support can include a lever which is pivotable about a predetermined axis (e.g., about an axis which is parallel to and is located between the axes of the rotary members or portions of the stretching means) between a plurality of different positions. The lever can be provided with an elongated slot (e.g., with a slot extending substantially radially of the pivot axis of the lever) and the at least one bending device can be mounted on the lever in such a way that it is adjustable relative to the lever at least substantially longitudinally of the elongated slot.

The altering means can further comprise a common carrier (e.g., a plate or the like) for the rotary portions or members of the stretching means, and this carrier is or can be pivotable about the axis of the second rotary member of the stretching means. If such altering means further comprises means for bending the intermediate products in the second portion of the predetermined path between the two rotary members or portions of the stretching means, the bending means can be mounted on and is then pivotable with the carrier about the axis of the second rotary member.

The invention is also embodied in an apparatus for imparting a predetermined shape to intermediate products which constitute converted substantially flat strips of deformable wire-like material and are to be used as binding elements for perforated sheets, panels and the like. The apparatus comprises means for transporting the intermediate products in a predetermined direction along a predetermined path, and means for altering at least some of the intermediate products in such predetermined path. The altering means can comprise at least one of (a) means for stretching the at least some of the intermediate products in the predetermined direction, and (b) means for bending the at least some of the intermediate products substantially transversely of the predetermined direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 2 an elevational view of a portion of a flat strip which can be shaped and transported in the improved apparatus;

FIG. 3 is a fragmentary perspective view of a partly or fully converted strip;

DESCRIPTION OF PREFERRED EMBODIMENTS

Figure 1:
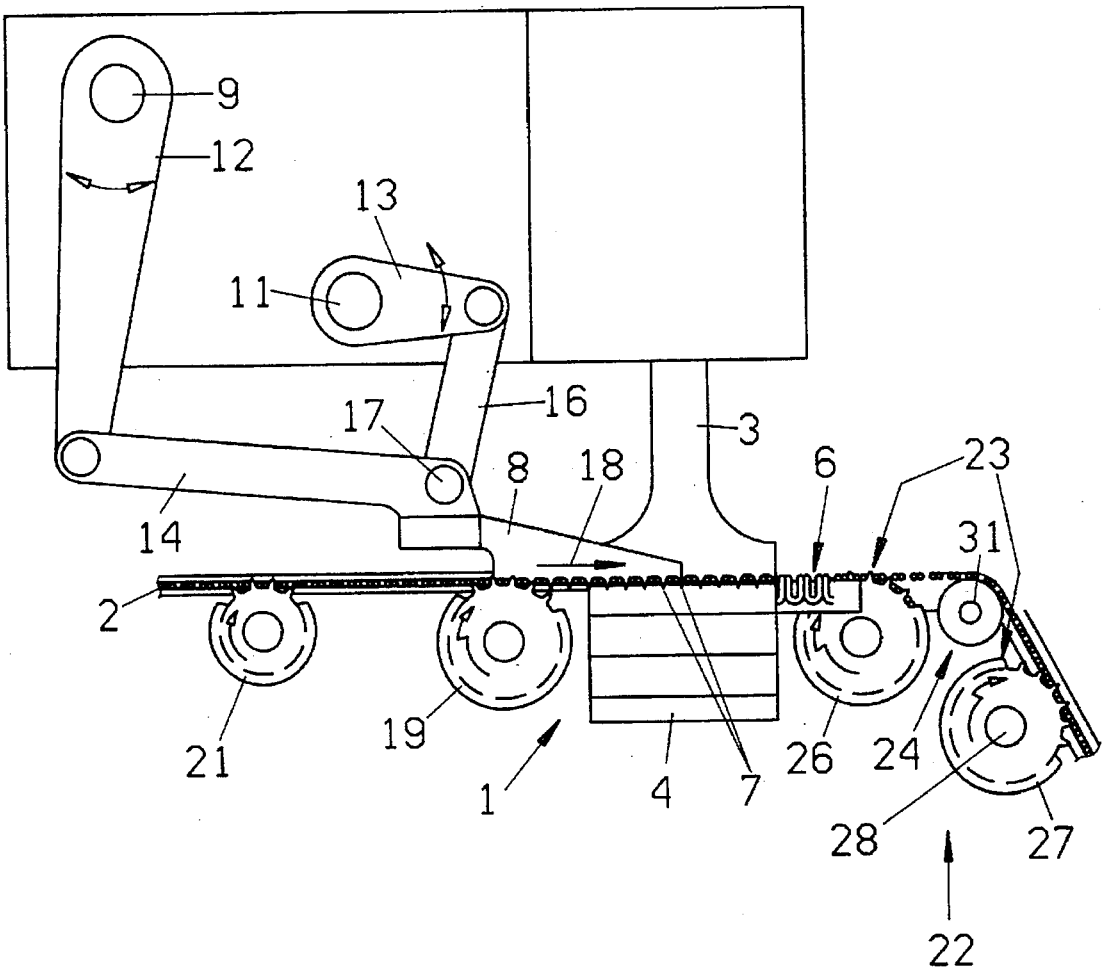
FIG. 1 is a somewhat schematic elevational view of an apparatus which is designed to convert substantially flat strips of deformable zig-zag wire into binding elements for accumulations of overlying aligned perforated sheets in accordance with a first embodiment of the present invention.

FIG. 1 shows an apparatus 1 which serves to impart a predetermined shape to blanks 2 (FIG. 2) in the form of substantially flat strips made of zig-zag wire which is being supplied from a source (not shown) of prefabricated strips on blank 2 or directly from a machine (not shown) wherein a length of metallic wire or other suitable wire is being converted into a continuous strip 2 or into a series of such strips. The apparatus 1 has means for transporting the strips or blanks 2 (hereinafter called strips) in a predetermined direction (arrow 18) along a predetermined elongated path which, in FIG, 1, includes a substantially horizontal elongated first or upstream part and a downwardly sloping second or downstream part leading to a magazine for finished binding elements or directly to a machine (not shown) wherein such binding elements are put to use for connecting accumulations of overlying perforated sheets to each other in a manner not forming part of the present invention. The transporting means of the apparatus 1 which is shown in FIG. 1 comprises an elongated toothed rack 8 which is movable forwardly and backwards in and counter to the direction indicated by the arrow 18, an idler gear 21 adjacent to a first portion of the path wherein the strips 2 advance toward and through a strip converting unit, a driven gear 19 which is adjacent the first portion of the path downstream of the idler gear 21 but upstream of the strip converting unit, and two rotary members 26, 27 shown in the form of gears adjacent a second portion of the path downstream of the strip converting unit.

The teeth 7 of the reciprocable toothed rack 8 are movable into and out of mesh with complementary portions (see FIG. 2) of strips 2 which are being fed along the aforementioned first portion of the path toward and beyond the driven gear 19. The mechanism for reciprocating the rack 8 includes two driven shafts 9 and 11 which receive motion from at least one suitable prime mover (not shown), pivotable levers 12, 13 which respectively receive motion from the shafts 9 and 11, a shaft 17 which carries the rack 8, and two links 14, 16 which connect the shaft 17 with the levers 12 and 13, respectively. FIG. 1 shows the toothed rack 8 in its starting or rearmost position in which the teeth 7 mate with the adjacent portions of a strip 2. The rack 8 thereupon moves in the direction of the arrow 18 to advance the adjacent strip 2 in the same direction (toward the gear 26). When it completes the forward stroke, the rack 8 maintains its teeth 7 at a level above and out of mesh with the adjacent strip or strips 2 so that it can proceed with a return stroke back toward the position of FIG. 1 wherein its teeth 7 enter the transversely extending slots or spaces of the adjacent strip or strips 2.

The gear 19 is driven in synchronism with the toothed rack 8 and its teeth also mate with the adjacent strip or strips 2 so that the parts 8 and 19 cooperate in advancing strips toward the converting unit, i.e., in the direction of the arrow 18. The location of the driven gear 19 is preferably selected in such a way that its teeth not only mate with the adjacent portions of one or more strips 2 but also with the teeth 7 of the rack 8 when the latter is caused to assume the fully retracted position of FIG. 1. Such mounting of the driven gear 19 relative to the rack 8 ensures that the strips between the parts 8 and 19 are held against any, or any appreciable, vibratory and/or other stray movements on their way toward the gears 26 and 27. Moreover, such mounting of the gear 19 ensures that the teeth 7 more reliably enter the adjacent portions of the strips 2 when the rack 8 is returned to the fully retracted position of FIG. 1.

The idler gear 21 constitutes an optional feature of transporting means for strips 2 and for intermediate products 6 as well as for those intermediate products 6 which are altered in the second portion of the path because their configuration does not sufficiently match the desired or optimum shape such as is necessary for convenient introduction of finished binding elements into the perforations of stacked paper sheets or the like. The primary purpose of the idler gear 21 is to render the transport of strips 2 toward the gears 26, 27, and more particularly toward the converting unit, even more predictable, i.e., to further prevent any undesirable or excessive stray movements of the strips in the corresponding portion of their path.

The aforementioned converting unit comprises a hold down device 3 at a level above the path for the strips 2 and a matrix 4 at a level below such path and in register with the hold down device 3. When it assumes its foremost position, the toothed rack 8 preferably overlies the matrix 4. The latter cooperates with the hold down device 3 to convert successive strips 2 or successive increments of a strip into intermediate products 6 of the type shown in FIG. 3, i.e., into products which constitute transversely curved or deformed strips and have a generally C-shaped cross-sectional outline. The exact construction of the converting unit for strips 2 forms no part of the present invention. For example, such unit can be constructed and assembled in a manner as disclosed in the aforementioned U.S. Pat. No. 4,873,858 the disclosure of which is incorporated herein by reference.

At least those intermediate products 6 the configuration of which departs from a desired or optimum or predetermined shape beyond an acceptable extent are subjected to additional treatment or shaping in an altering unit 22 adjacent the second portion of the path for strips 2 and intermediate products 6 downstream of the matrix 4 (as seen in the direction of the arrow 18). The altering unit 22 preferably constitutes a composite assembly including two units which influence the shape of at least some intermediate products in different ways. The unit 22 of FIGS. 1 and 4 comprises a stretching unit 23 which is designed to elongate at least some of the intermediate products 6 in the longitudinal direction as indicated by the arrow 18, and a bending or flexing unit 24 which is designed to bend all of the intermediate products transversely of the direction indicated by the arrow 18.

Figure 4:
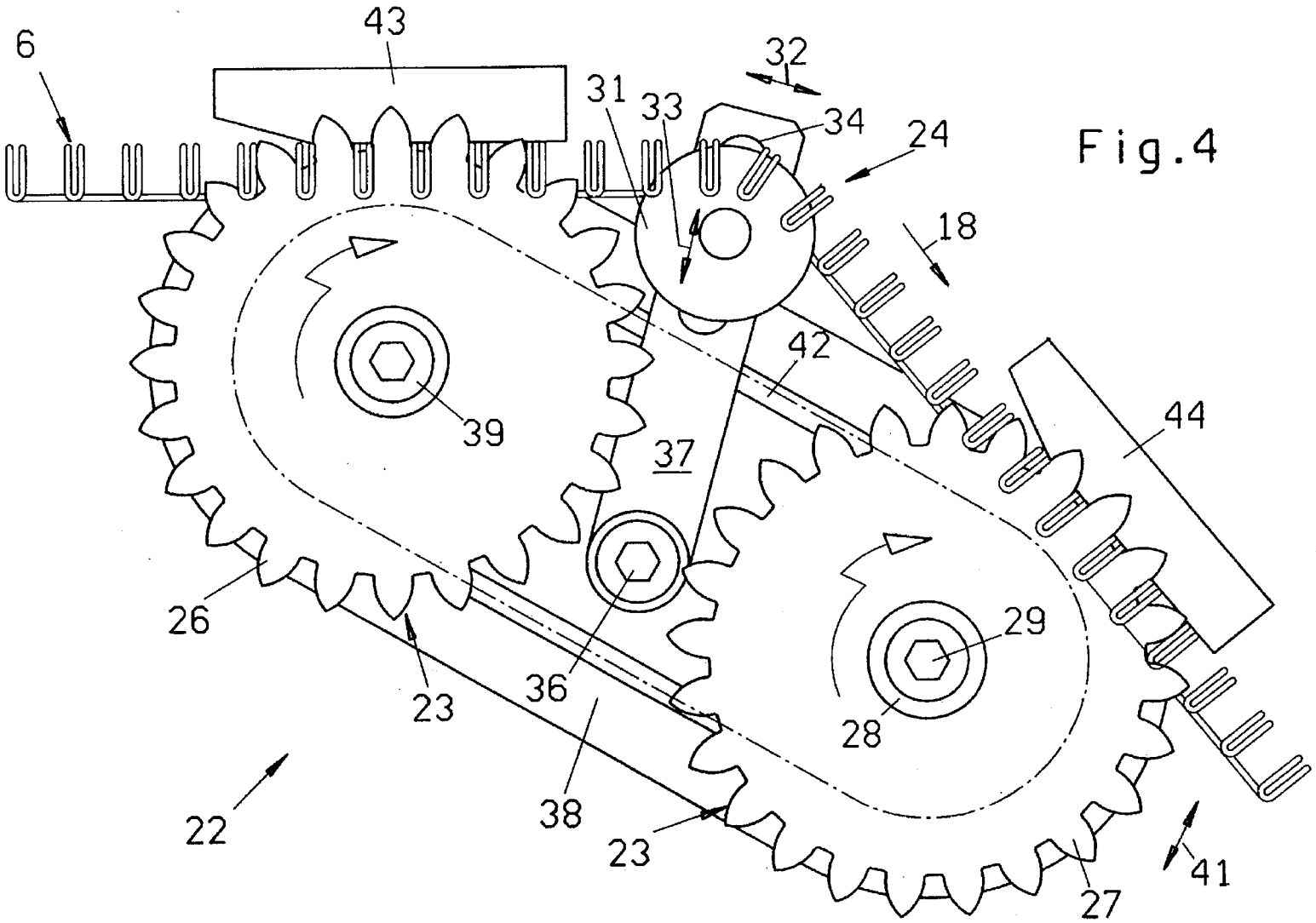
FIG. 4 is an enlarged view of a detail in the apparatus of FIG. 1, namely of means for altering the shape of intermediate products to form binding elements having a configuration which at least closely approximates an optimum shape.

The stretching unit 23 of the shape correcting or altering unit 22 includes the aforementioned rotary members 26, 27 which, as can be best seen in FIG. 4, can constitute gears and form part of the aforediscussed transporting unit for strips 2 and intermediate products 6. The gears 26, 27 have identical circular pitches and are driven, either continuously or stepwise, in such a way that they carry out identical angular movements. The teeth of the gears 26, 27 mate with the adjacent portions of the intermediate products 6. The extent to which the intermediate products 6 can be stretched by the gears 26, 27 can be varied by changing the angular position of the downstream gear 27 (as seen in the direction of the arrow 18) relative to the upstream gear 26 at least in a clockwise direction as viewed in FIG. 4, i.e., in a direction to increase the stretch upon an intermediate product 6 which meshes with the gears 26 and 27 and is being advanced in the direction of the arrow 8. To this end, the angular position of the gear 27 relative to its shaft 28 can be changed upon loosening of a locking or arresting device 29 which is reengaged to maintain the gear 27 in a newly selected angular position relative to the shaft 28. The shaft 28 and a shaft 39 for the year 26 define for the respective gears two parallel axes which are normal to the direction indicated by the arrow 18. The angular position of the downstream gear 27 relative to the angular position of the upstream gear 26 is selected in such away that, when necessary, the teeth of these gears carry out upon the adjacent intermediate products a stretching action which suffices to ensure that any unanticipated and undesirable internal stresses of the products 6 are fully or sufficiently overcome so as to ensure that the prongs of the thus obtained binding elements can readily enter the perforations in the stacks of aligned sheets which are to be pivotably bonded to each other. The manner in which the prongs of properly inserted binding elements are deformed upon introduction into the respective sets of aligned perforations to prevent unintentional separation of the overlapping sheets from each other is well known in the relevant art and need not be described here. All that counts is to ensure that the improved stretching unit 23 be provided with facilities to permit a change of angular positions of the gears 26, 27 relative to each other in order to select an optimum stretching action (when necessary) upon those intermediate products 6 which are being advanced (by the gears 26, 27) in the second portion of the predetermined path for the strips 2, for the intermediate products 6 and for the finished binding elements.

The stretching action of the gears 26, 27 is sufficiently pronounced and is carried out for sufficiently long intervals of time to ensure that the shape of the thus altered intermediate products 6 matches a predetermined optimum shape which is required to guarantee convenient and predictable insertion of the thus obtained finished products into the perforations of stacked paper sheets or the like. The arresting device 29 is loosened whenever necessary to adjust the angular position of the downstream gear 27 relative to that of the upstream gear 26 in order to change the stretching action upon the intermediate products 6 advancing along the second portion of their path.

The linearity of the binding elements can be adversely influenced by the converting unit including the hold down device 3 and the matrix 4 and/or by the stretching unit 23. Such linearity can be maintained or restored by the bending unit 24 which includes a substantially cylindrical bending device 31 in the form of a bolt, pin or the like engaging the intermediate products 6 in that portion of the path which is located between the gears 26, 27 forming part of the stretching unit 23 as well as of the transporting unit. The bending device 31 of FIGS. 1 and 4 is adjustable in a plurality of different directions as indicated by the double-headed arrows 32, 33, preferably least substantially at right angles to each other. The bending unit 24 comprises a support in the form of an elongated lever 37 which is pivotable with or about a shaft 36 to permit an adjustment of the bending device 31 in directions indicated by the arrow 32. The lever 37 has an elongated slot 34 which extends at least substantially radially of the shaft 36 and series to permit adjustments of the shaft of the bending device 24 in directions indicated by the arrow 33. The lever 37 can be fixed in a selected angular position relative to the axis of the shift 36, and the bending device 31 can be rotatably secured to the lever 37 in a position at a selected radial distance from the shaft 36 in any suitable manner not forming part of the instant invention.

FIG. 4 further shows that the shafts 28, 39 for the gears 27, 26 are mounted on a common carrier 38 which is pivotable (in directions indicated by a double-headed arrow 41) about the axis of the shaft 39 to be thereupon fixed in a newly selected angular position. The carrier 38 further supports the shaft 36 for the lever 37, i.e., the entire bending unit 24 is or can be mounted on the common carrier for the gears 26, 27 of the stretching unit 23.

The gears 26, 27 carry or are connected to coaxial pulleys or sprocket wheels (not specifically shown) and an endless flexible element 42 (such as a belt or a chain) is trained over such pulleys or sprocket wheels to synchronize the angular movements of the gears 26, 27 with each other.

FIG. 4 further shows two locating strips or analogous members 43, 44 which are respectively adjacent and disposed opposite the gears 26, 27 to ensure predictable guidance of intermediate products 6 during advancement along the second portion of the predetermined common path for the strips 2, intermediate products 6 and finished binding elements.

An important advantage of the improved apparatus is that it can reliably correct the shape of each and every intermediate product 6 the shape of which departs from a predetermined configuration or shape to an extent such as could cause problems during introduction of prongs of binding elements into the perforations of stacked sheets or panels of paper, cardboard, plastic or the like. In other words, the mutual spacing of prongs or teeth forming part of suitably bent and stretched intermediate products 6 (i.e., finished binding elements) matches the mutual spacing of perforations in groups of aligned overlapping panels and/or sheets which are to be pivotably connected with each other to constitute or to form part of books, brochures, manuals, calendars, catalogues, pads or other stationery or analogous products.

The bending unit 24 actually constitutes a straightening or correcting unit which eliminates the undesirable curving of strips 2 during conversion into intermediate products 6 between the hold down device 3 and the matrix 4 as well as during stretching of intermediate products 6 between the gears 26 and 27. More specifically, the gears 26, 27 might, at least a times, promote or at least fail to oppose the tendency of the intermediate products 6 to curve or bend as a result of deformation of the blanks (strips 2) between the hold down device 3 and the matrix 4 of the converting unit. It has been found that the unit 24 is capable of eliminating all or practically all undesirable deformation which the strips 2 and intermediate products 6 tend to undergo during advancement from the idler gear 21 toward the gear 27.

It has been found that the straightening or correcting action of the bending unit 24 (i.e., the action of the bending device 31 upon the intermediate products 6) is particularly satisfactory if this device engages the intermediate products 6 in that part of the second portion of the predetermined path which is located between the gears 26 and 27. The practically universal adjustability of the bending device 31 (as indicated by the double-headed arrows 32 and 33) also contributes to the reliability of corrective action of the unit 24 upon the intermediate products 6.

The illustrated bolt- or pin-shaped bending device 31 can be replaced with a roller (not shown) without departing from the spirit of the invention.

Figure 5:
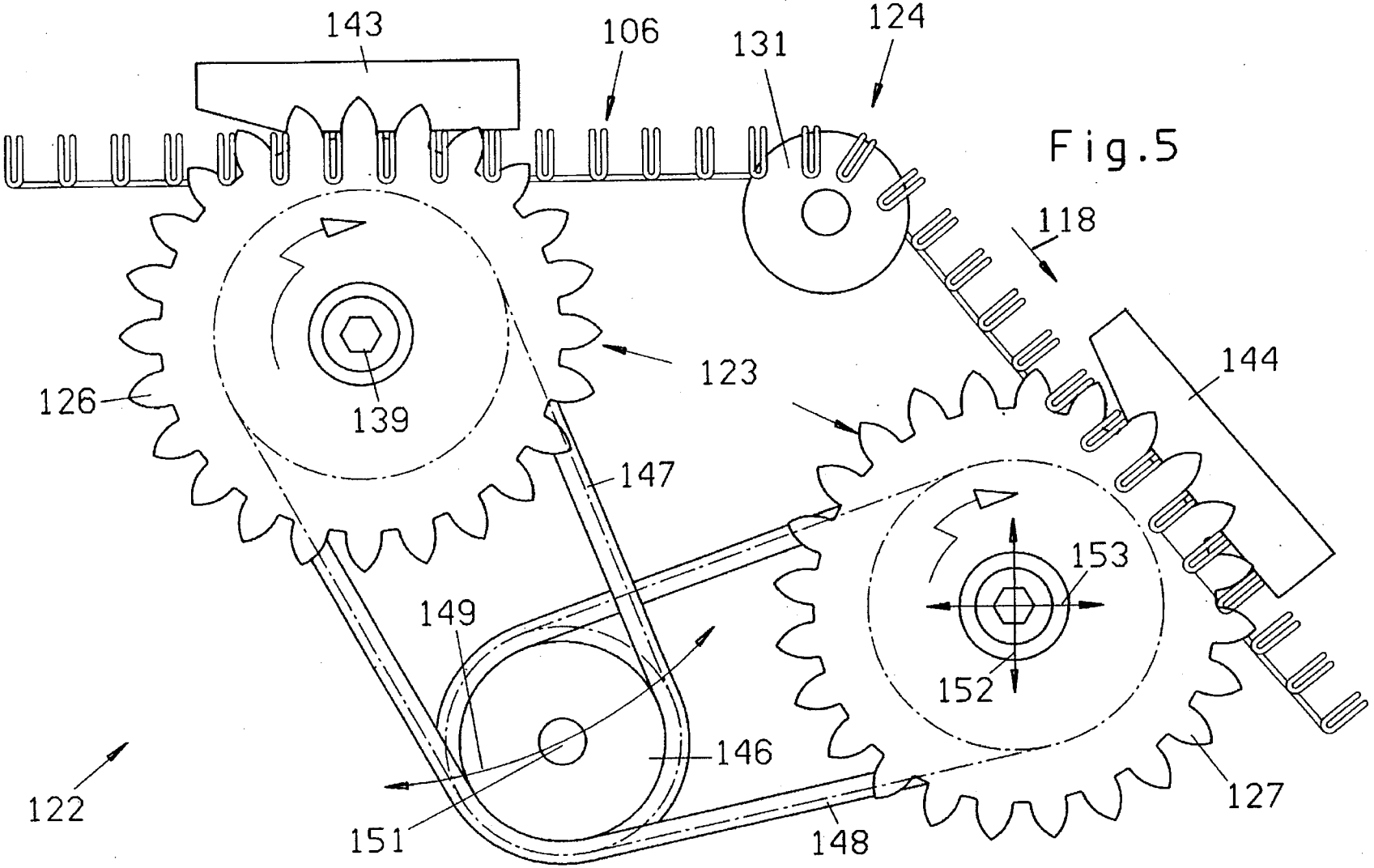
FIG. 5 is a view similar to that of FIG. 4 but showing a second embodiment of the means for altering the shape of intermediate products.

FIG. 5 shows a portion of a modified apparatus and all such parts of this modified apparatus which are identical with or clearly analogous to the corresponding parts of the apparatus shown in FIGS. 1 and 4 are denoted by similar reference characters plus 100. The apparatus of FIG. 5 comprises a modified torque transmitting connection between the gears 126, 127 of the stretching unit 123 forming part of the shape correcting or altering unit 122. The torque transmitting connection comprises a rotary intermediate member 146 (e.g., a twin pulley or a twin sprocket wheel), an endless flexible element (such as a belt or chain) 147 which is trained over a pulley or sprocket wheel of the gear 126 and one pulley or sprocket wheel of the intermediate member 146, and a second endless flexible element 148 trained over a pulley or sprocket wheel of the gear 127 and the other pulley or sprocket wheel of the intermediate member. The shaft 151 of the intermediate member 146 is mounted on a carrier (not shown in FIG. 5 but corresponding, for example, to the aforementioned carrier 38 shown in FIG. 4) and is adjustable about the axis of the shaft 139 (together with the shaft for the gear 127) in directions indicated by a double-headed arrow 149. The shaft of the gear 127 is preferably adjustable relative to the intermediate member 146 (i.e., relative to the aforementioned carrier for the member 146) in directions which are indicated by the double-headed arrows 152 and 153. Such adjustability of the intermediate member 146 relative to the gear 126 and of the gear 127 relative to the intermediate member 146 has been found to suffice to ensure that the stretching action of the gears 126, 127 upon the intermediate products 106 can be selected within a desired or required range.

Figure 6:
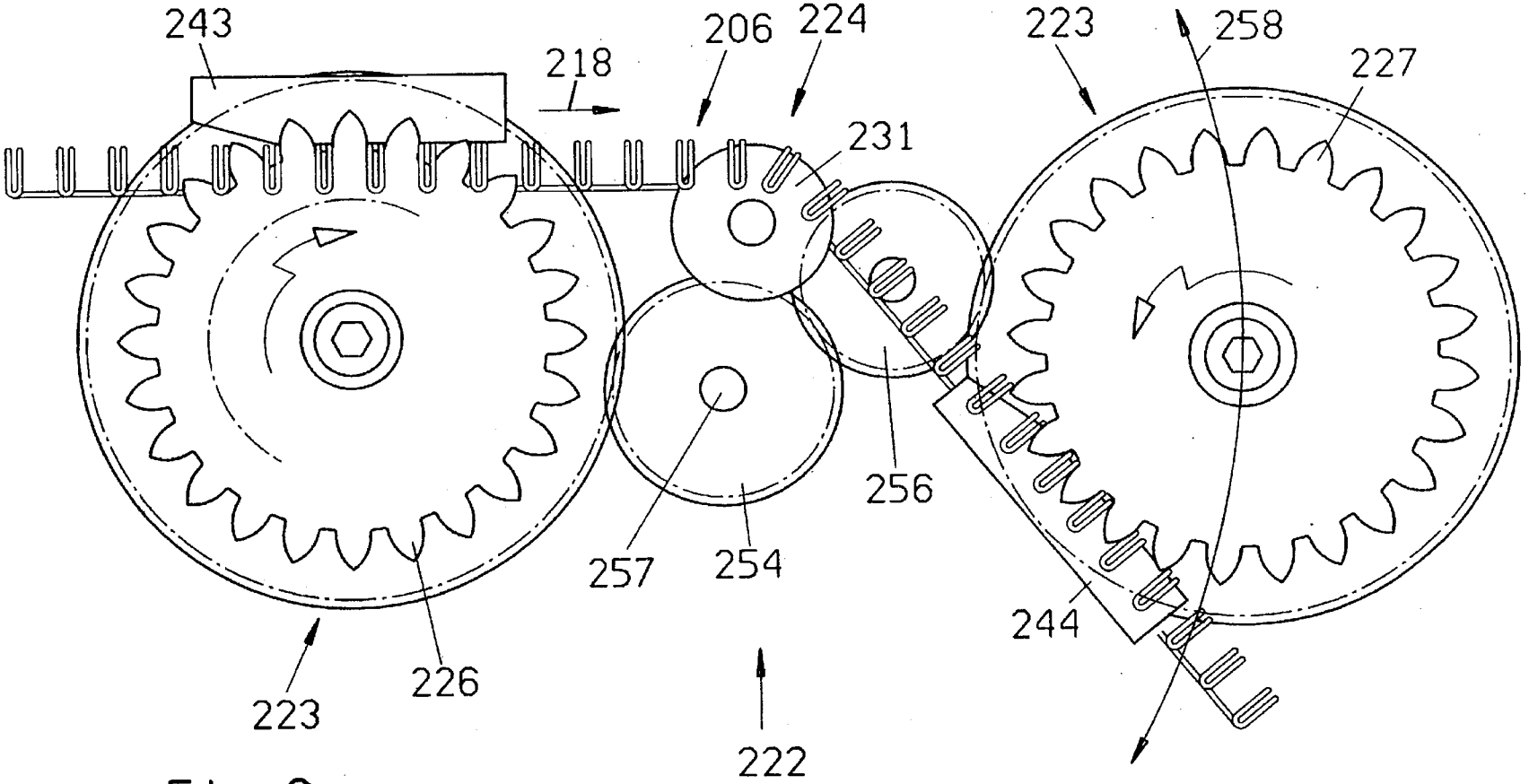
FIG. 6 is a view similar to that of FIG. 4 or 5 but showing a third embodiment of the means for altering the shape of intermediate products.

FIG. 6 shows a portion of a third apparatus. All such parts of this third apparatus which are identical with or clearly analogous to the corresponding parts of the apparatus shown in FIGS. 1 and 4 are denoted by similar reference characters plus 200. The gear 227 is located at one side and the gear 226 is located at the other side of the elongated path for the intermediate products 206. The torque transmitting connection between the gears 226, 227 comprises a gear train including two spur gears 254, 256. The gear 254 meshes with a spur gear forming part of or secured to the gear 226, and the gear 256 mates with the gear 254 as well as with a spur gear forming part of or secured to the gear 227. A carrier (not shown) for the shaft of the gear 227 is turnable about the axis of a shaft 257 for the spur gear 254, i.e., the gear 227 is adjustable relative to the gear 226 in directions indicated by a double-headed arrow 252. This renders it possible to select the stretching action of the unit 223.

It is clear that the features of the apparatus respectively shown in FIGS. 4, 5 and 6 can be combined with each other or interchanged without departing from the spirit or scope of the instant invention.

Still further, it is possible to modify each of the illustrated apparatus by providing discrete prime movers for the gears of the stretching unit and by providing means for adjusting the angular position of one of these gears relative to the other gear. For example, the synchronizing means including the endless flexible torque transmitting element 42 of FIG. 4 can be omitted if the apparatus of FIGS. 1 and 4 is equipped with a first prime mover (such as an electric motor) for the upstream stretching gear 26, with a second prime mover (such as a variable-speed electric motor) for the downstream stretching gear 27, and with suitable means for adjusting or permitting an adjustment of the gear 27 relative to the gear 26 for the purposes of varying the stretching action of the unit including the stretching gears 26 and 27 within a desired or required range. The prime mover for the gear 27 could form part of or could constitute such adjusting means.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for imparting a predetermined shape to substantially flat strips of deformable wire binding elements for perforated sheets, comprising means for transporting wire binding elements in a predetermined direction along a predetermined path;

means for converting strips in a first portion of said path into transversely curved intermediate products having a shape at least approximating said predetermined shape;

means for altering in a second portion of said path, downstream of said first portion as seen in said predetermined direction, at least those intermediate products the shape of which departs from said predetermined shape;

said altering means comprising stretching means for stretching the intermediate products in said predetermined direction wherein said stretching means comprises first and second rotary members spaced apart from each other in said predetermined direction and having portions mating with complementary portions of the intermediate products in said second portion of said path, said rotary members being rotatable about discrete axes and said first rotary member being located downstream of said second rotary member as seen in said predetermined direction, said stretching means further comprising means for transmitting torque between said rotary members and said torque transmitting means including a rotary intermediate member rotatable about a third axis and adjustable jointly with said first rotary member about the axis of said second rotary member, said first rotary member being adjustable about said third axis relative to said intermediate member.

2. The apparatus of claim 1, wherein said intermediate products have a substantially C-shaped cross-sectional outline.

3. The apparatus of claim 1, wherein said altering means forms part of said transporting means.

4. The apparatus of claim 1, wherein said rotary members include gears having at least substantially identical circular pitches.

5. The apparatus of claim 1, wherein said rotary members are rotatable about discrete axes and at least one of said rotary members is angularly adjustable about one of said axes relative to the other of said rotary members.

6. The apparatus of claim 5, wherein said at least one rotary member is located downstream of said other rotary member as seen in said predetermined direction.

7. The apparatus of claim 6, wherein said at least one rotary member is angularly adjustable relative to said other rotary member at least in a sense to increase the stretching action of said rotary members upon the intermediate products in said second portion of said path.

8. The apparatus of claim 1, wherein said torque transmitting means further comprises at least one first endless flexible torque transmitting element trained over said first rotary member and said intermediate member and at least one second endless torque transmitting element trained over said second rotary member and said intermediate member.

9. The apparatus of claim 1, wherein said rotary members are rotatable about discrete axes and said first rotary member is disposed downstream of said second rotary member as seen in said predetermined direction, said first and second rotary members engaging the intermediate products at-opposite sides of said predetermined path.

10. The apparatus of claim 1, wherein said altering means includes means for bending the intermediate products in said second portion of said predetermined path.

11. The apparatus of claim 10, wherein said bending means includes at least one device for bending the intermediate products substantially transversely of said predetermined direction.

12. The apparatus of claim 10, wherein said bending means comprises at least one bending device adjustable relative to said second portion of said predetermined path in a plurality of different directions.

13. Apparatus for imparting a predetermined shape to substantially flat strips of deformable wire binding elements for perforated sheets, comprising means for transporting wire binding elements in a predetermined direction along a predetermined path;

means for converting strips in a first portion of said path into transversely curved intermediate products having a shape at least approximating said predetermined shape;

means for altering in a second portion of said path, downstream of said first portion as seen in said predetermined direction, at least those intermediate products the shape of which departs from said predetermined shape; and stretching means provided in said altering means for stretching the intermediate products in said predetermined direction, wherein said stretching means comprises first and second rotary members spaced apart for each other in said predetermined direction and having portions mating with complementary portions of the intermediate products in said second portion of said path and said rotary members are rotatable about discrete axes and said first rotary member is disposed downstream of said second rotary member as seen in said predetermined direction, said first and second rotary members engaging the intermediate products at opposite sides of said predetermined path wherein said first rotary member is adjustable relative to said predetermined path about a third axis remote from said discrete axes.

14. Apparatus for imparting a predetermined shape to substantially flat strips of deformable wire binding elements for perforated sheets, comprising means for transporting wire binding elements in a predetermined direction along a predetermined path;

means for converting strips in a first portion of said path into transversely curved intermediate products having a shape at least approximating said predetermined shape;

means for altering in a second portion of said path, downstream of said first portion as seen in said predetermined direction, at least those intermediate products the shape of which departs from said predetermined shape;

said altering means including means for bending the intermediate products in said second portion of said predetermined path, said bending means comprising at least one bending device adjustable relative to said second portion of said predetermined path in a plurality of different directions including at least one first direction and at least one second direction extending at least substantially at right angles to said at least one first direction.

15. Apparatus for imparting a predetermined shape to substantially flat strips of deformable wire binding elements for perforated sheets, comprising means for transporting wire binding elements in a predetermined direction along a predetermined path;

means for converting strips in a first portion of said path into transversely curved intermediate products having a shape at least approximating said predetermined shape;

means for altering in a second portion of said path, downstream of said first portion as seen in said predetermined direction, at least those intermediate products the shape of which departs from said predetermined shape, said altering means including:

means for bending the intermediate products in said second portion of said predetermined path; and means for stretching the intermediate products in said second portion of said predetermined path, said stretching means including first and second portions respectively disposed downstream and upstream of said bending means as seen in said predetermined direction.

16. The apparatus of claim 15, wherein said bending means includes at least one bending device arranged to engage the intermediate products in said second portion of said path between said first and second portions of said stretching means, and a support for said at least one bending device, said at least one bending device being adjustably mounted on said support.

17. The apparatus of claim 16, wherein said support includes a lever pivotable about a predetermined axis between a plurality of different positions, said lever having an elongated slot and said at least one bending device being adjustable relative to said lever at least substantially longitudinally of said slot.

18. Apparatus for imparting a predetermined shape to substantially flat strips of deformable wire binding elements for perforated sheets, comprising means for transporting wire binding elements in a predetermined direction along a predetermined path;

means for converting strips in a first portion of said path into transversely curved intermediate products having a shape at least approximating said predetermined shape; and means for altering in a second portion of said path, downstream of said first portion as seen in said predetermined direction, at least those intermediate products the shape of which departs from said predetermined shape, said altering means comprising means for stretching the intermediate products in said predetermined direction and said stretching means comprising first and second rotary members spaced apart from each other in said predetermined direction and having portions engaging complementary portions of intermediate products in said second portion of said predetermined path, said first rotary member being disposed downstream of said second rotary member as seen in said predetermined direction and said rotary members being rotatable about discrete axes, said altering means further comprising a common carrier for said rotary members and said carrier being pivotable about the axis of said second rotary member.

19. The apparatus of claim 18, wherein said altering means further comprises means for bending the intermediate products in said second portion of said predetermined path between said rotary members, said bending means being mounted on and being pivotable with said carrier.

* * * * *